US008393030B2

(12) United States Patent
Pichon et al.

(10) Patent No.: US 8,393,030 B2
(45) Date of Patent: Mar. 12, 2013

(54) SUBMERGED-SURFACE CLEANING APPARATUS WITH ANGLED FILTRATION SYSTEM

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 155 days.

(21) Appl. No.: 12/808,436

(22) PCT Filed: Dec. 18, 2008

(86) PCT No.: PCT/FR2008/052369

§ 371 (c)(1),
(2), (4) Date: Sep. 13, 2010

(87) PCT Pub. No.: WO2009/081059

PCT Pub. Date: Jul. 2, 2009

(65) Prior Publication Data

US 2011/0005009 A1 Jan. 13, 2011

(30) Foreign Application Priority Data

Dec. 21, 2007 (FR) ..... 07 08995

(51) Int. Cl.
*E04H 4/16* (2006.01)

(52) U.S. Cl. ..... 15/1.7; 210/167.1; 210/167.16; 210/416.2

(58) Field of Classification Search ..... 15/1.7; 210/167.1, 167.16, 167.17, 416.2, 459; 4/490, 4/496; 134/110, 109, 167 R, 168 R; *E04H 4/16*
See application file for complete search history.

(56) References Cited

U.S. PATENT DOCUMENTS 4,768,532 A * 9/1988 Johnson ..... 134/111
5,842,243 A * 12/1998 Horvath et al. ..... 15/1.7
(Continued)

FOREIGN PATENT DOCUMENTS

EP 0483470 5/1992
EP 0989255 3/2000
EP 1074678 2/2001
(Continued)

OTHER PUBLICATIONS

International Search Report in Application No. PCT/FR2008/052369.

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface including a body and members for driving the body over the immersed surface, a filtration chamber which is provided in the body and which has a liquid inlet and a liquid outlet, a hydraulic circuit for flow of liquid between the inlet and the outlet through a filtering device, wherein the filtering device includes an opening which is in communication with the liquid inlet and, for filtering and recovering debris, a space which is delimited by filtering walls and which extends towards the liquid outlet, the space having a regular cross-section which decreases from the opening towards the liquid outlet in order to form a convergent chamber for tangential filtration of the liquid.

11 Claims, 6 Drawing Sheets

U.S. PATENT DOCUMENTS

Figure 1:
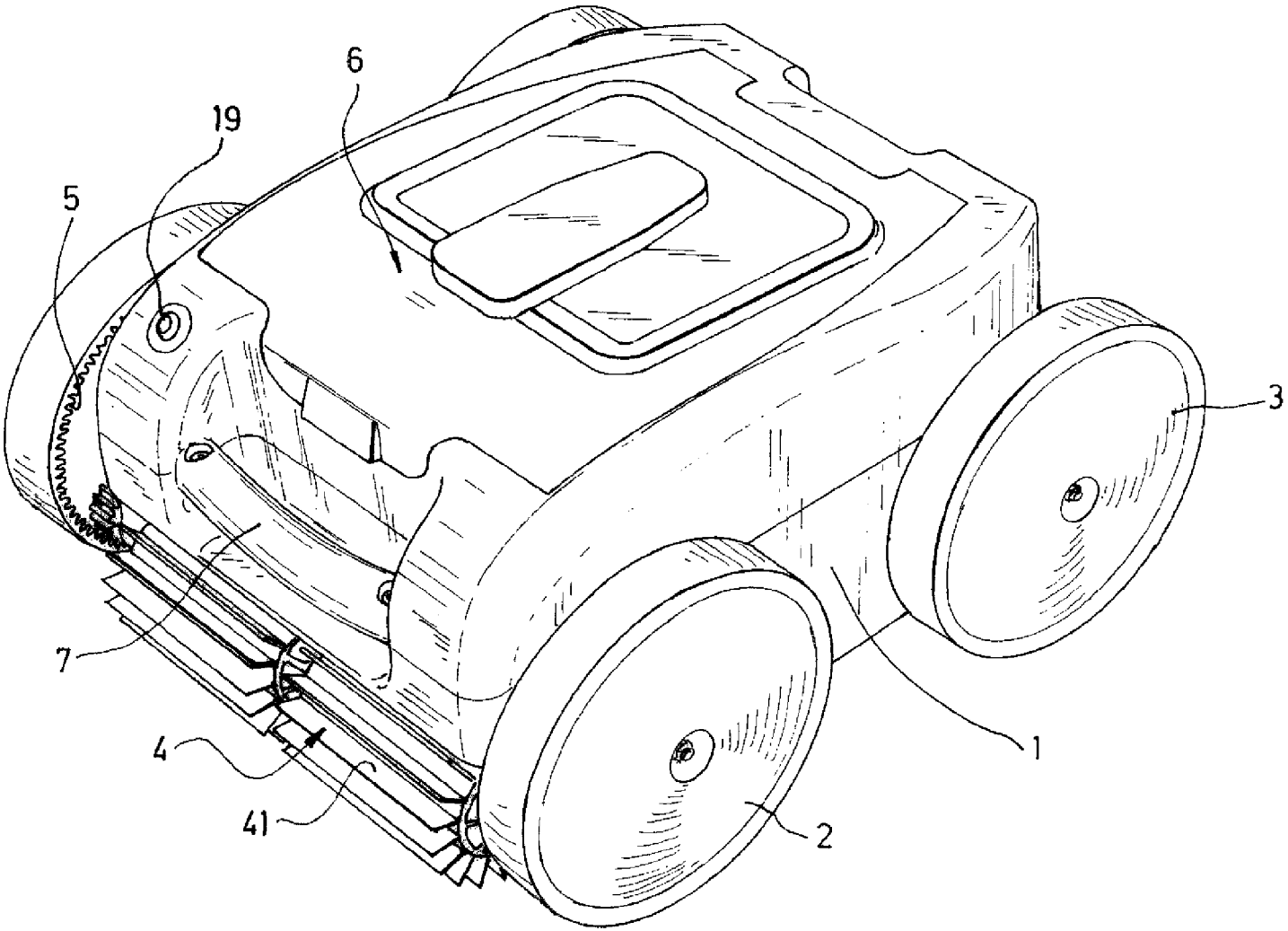

| | | | | |
|---|---|---|---|---|
| 6,013,178 | A * | 1/2000 | Strano et al. | 210/136 |
| 6,409,916 | B1 * | 6/2002 | Zelas et al. | 210/167.16 |
| 6,473,927 | B1 * | 11/2002 | Sommer | 15/1.7 |
| 6,627,074 | B2 * | 9/2003 | Lincke | 210/167.17 |
| 6,886,205 | B1 * | 5/2005 | Pichon | 15/1.7 |
| 2007/0251032 | A1 * | 11/2007 | Pichon et al. | 15/1.7 |

FOREIGN PATENT DOCUMENTS

| | | |
|---|---|---|
| FR | 2567552 | 1/1986 |
| FR | 2869058 | 10/2005 |
| WO | WO0250388 | 6/2002 |
| WO | WO02092189 | 11/2002 |

* cited by examiner

SUBMERGED-SURFACE CLEANING APPARATUS WITH ANGLED FILTRATION SYSTEM

CROSS REFERENCE TO RELATED APPLICATIONS

This application is the U.S. national phase of International Application No. PCT/FR2008/052369 filed on Dec. 18, 2008 and published on Jul. 2, 2009 as International Publication No. WO 2009/081059 A2, which application claims priority to French Patent Application No. 0708995 filed on Dec. 21, 2007, the entire contents of both of which are incorporated herein by reference.

The invention relates to a device for cleaning a surface which is immersed in a liquid, in particular a swimming pool surface.

A number of known swimming pool cleaning devices comprise:

- a hollow body and members for guiding and driving the body over the immersed surface in a preferred direction of advance and in a main direction of advance, called the longitudinal direction,
- a filtration chamber which is provided in the hollow body and which has:
- at least one liquid inlet into the hollow body located at the base and at the front of the hollow body,
- at least one liquid outlet out of the hollow body, located remotely from the base of the hollow body,
- a hydraulic circuit which is capable of providing a flow of liquid between each inlet and each outlet through a filtering device which is accommodated in the filtration chamber, under the action of a pumping device.

In these known devices (cf., for example, FR 2 567 552, WO 0 250 388, FR 2 869 058, . . . ), the hydraulic circuit extends in the filtration chamber vertically in an upward direction and at the front and the rear of a pumping motor which is arranged vertically, generally at the center of the hollow body. It is considered that this arrangement promotes the efficiency of the pump by minimizing the pressure losses and by optimizing the flow and the filtration.

The inventors have now established that this arrangement is extremely unfavorable with respect to the performance levels of the device. It is relatively large in the vertical direction which involves in particular a higher level of hydraulic resistance to forward movement, and therefore higher energy consumption, a greater weight and size and therefore finally, with equivalent performance levels, a high cost.

Furthermore, a flap for access to the filtration device may be provided in order to allow it to be disassembled in order for it to be cleaned. In the prior devices mentioned above, the flap for access to the filtration device must be located at the base of the hollow body, the liquid inlets being necessarily provided with non-return devices, such as valves. This arrangement is not convenient for the user who must invert the device beforehand, which can damage it and further bring about undesirable occurrences of untimely flow. Otherwise, if the access flap is arranged above the device, the hydraulic circuit must have a particularly complex path (cf., for example, U.S. Pat. No. 6,409,916) which is costly to produce, difficult to clean and which brings about significant pressure losses in the circuit which in particular involves the pumping motor being oversized.

Furthermore, in the prior devices, the filtering device, even when it has a large volume, can become clogged relatively quickly owing to a few large items of debris such as dead leaves, which involves frequent cleaning of the filtering device.

In this context, an object of the invention is therefore to provide, for cleaning an immersed surface, a device whose cost/performance ratio is greatly improved compared with that of prior devices. More specifically, an object of the invention is to provide such a device whose cost can be substantially reduced with performance levels which are equivalent to or even greater than those of known devices.

An object of the invention is also to provide a device of this type, which may have an access flap located at the upper portion but with a filtration device having improved efficiency, and which has a large volume for storage of debris and a simple hydraulic circuit which brings about low pressure losses.

To this end, the invention relates to a device for cleaning an immersed surface comprising:

- a hollow body and members for guiding and driving the body over the immersed surface in a preferred direction of advance and in a main direction of advance, called the longitudinal direction,
- in the hollow body, a filtration chamber comprising:
- at least one liquid inlet into the hollow body, located at the base and at the front of the hollow body,
- at least one liquid outlet out of the hollow body, located remotely from the base of the hollow body,
- a hydraulic circuit which is capable of providing a flow of liquid between each inlet and each outlet through a filtering device which is accommodated in the filtration chamber, under the action of a pumping device,
- a flap for access to the filtering device, which is provided on an upper wall of the hollow body and which is capable of allowing the filtering device to be disassembled and removed from the hollow body in order for it to be cleaned, wherein the filtering device comprises at least one front opening which is in communication with at least one liquid inlet, and, for filtering and recovering debris, at least one space which is delimited by filtering walls and which extends longitudinally towards at least one liquid outlet, this space for filtering and recovering debris having a regular cross-section which decreases from this front opening towards this liquid outlet in order to form, at least when the pumping device is active, a convergent chamber for filtration of the liquid which flows between this front opening and this liquid outlet.

The inventors have found that that this specific arrangement in practice allows the suction levels to be retained whilst at the same time significantly reducing the vertical spatial requirement thereof, and therefore the hydraulic drag thereof, with a filtering device which is particularly efficient, which has a large storage volume for debris and with no detrimental loss of pressure.

Furthermore, a filtering device which has at least one space for filtering and recovering debris which converges from a liquid inlet towards a liquid outlet allows substantially tangential filtration to be provided for the liquid flowing in the filtering device between this inlet and this outlet. Such filtration which is mainly tangential limits the clogging from obstructive debris (such as dead leaves) on the filtering walls of the device which ensures a good suction and good filtering action including after a long period of operation.

A filtering device of a device according to the invention has no filtering wall normal relative to the liquid flow direction. Furthermore, each space for filtering and recovering debris is exclusively delimited by filtering walls, that is to say, walls which are principally formed by members which are permeable with respect to water and impermeable with respect to debris. Since all the walls which delimit the space for filtering and recovering debris have a filtering action and since each wall is arranged in such a manner that it provides a substantially tangential filtration of the liquid, a filtering device of a device according to the invention limits the clogging of all of the walls of the filtering device in a particularly effective manner.

Furthermore, it would appear that such a recovery space, converging from a liquid inlet—in particular from each liquid inlet—towards a liquid outlet—in particular towards each liquid outlet—also brings about a swirling action of the liquid flowing in this space for filtering and recovering debris, which also contributes towards providing continuous cleaning of the walls which delimit this space which has the effect of restoring the initial permeability to the various walls which delimit this space.

According to an advantageous variant of the invention, the filtering device comprises a single front opening which is in communication with a single space for filtering and recovering debris and a single rear liquid outlet.

Advantageously and according to the invention, at least one liquid outlet out of the hollow body, called the rear outlet, is offset towards the rear, in the longitudinal direction, from each liquid inlet with which it is in communication via the hydraulic circuit.

This arrangement allows the device to be configured in such a manner as to recover directly, with no pressure loss, at least part of the residual hydraulic energy in the outlet flow in order to contribute to driving the device.

Consequently, with equivalent suction and cleaning levels, a device according to the invention may be provided with a pumping motor—in particular an electric pumping motor—and a driving device—comprising in particular at least one electric drive motor—whose power is reduced and which therefore has lower consumption and costs. Consequently, the device is also generally smaller and lighter which, in addition to the savings made, is a significant advantage for the user, in particular in terms of handling, transport and storage of the device.

Preferably, the space for filtering and recovering debris is arranged immediately downstream of a front opening of the filtering device.

According to a first variant of the invention, the front opening of the filtering device is arranged immediately downstream of the liquid inlet in the hollow body of the device. According to this variant, the filtering device extends from a front extreme portion which is arranged in the region of the base of the body of the device to a rear extreme portion which is arranged approximately opposite the base of the body. According to such a variant, the filtering device extends integrally between each liquid inlet and each liquid outlet.

According to another variant, advantageously and according to the invention, each space for filtering and recovering debris is arranged immediately downstream of a front opening of the filtering device. Each space for filtering and recovering debris extends towards the rear of the opening and below this opening.

Such a space for filtering and recovering debris may, for example, be delimited by a flexible or rigid pocket for filtering and recovering debris, by a casing, a cartridge, or any equivalent means. The only condition is that the structure defines a space which has, when the pumping device is active, a regular cross-section which decreases from the front towards the rear in order to form a convergent filtration chamber which flows between this front opening and this liquid outlet. In particular, it is not necessary for the space to have such convergence when the pumping device is inactive. Advantageously, however, the structure which delimits the space for filtering and recovering debris is rigid and has such convergence, including when the pumping device is inactive.

If this space for filtering and recovering debris is delimited by a filtration pocket which is arranged immediately downstream of the front opening, the debris which have entered the pocket for recovering debris via the upper front opening of the pocket, if the pumping device is stopped, are confined to the base of the pocket by the natural action of gravity.

In particular, advantageously and according to the invention, each front opening of the filtering device is provided opposite an upper end of a liquid inlet conduit which extends from at least one liquid inlet, this liquid inlet conduit having a rear wall which is called a non-return wall and which extends transversely between the liquid inlet and the front opening, at the front of the space for filtering and recovering debris.

Such a transverse rear wall acts as a non-return wall and prevents the debris from leaving the space for filtering and recovering debris via a liquid inlet in order to return towards the immersed surface via the front opening. This non-return wall extends in a generally vertical plane between a zone at the rear of the liquid inlet and the upper front opening of the space for filtering and recovering debris. Preferably, this non-return wall extends over a main portion of the height of the inlet conduit, in particular over more than 75% of the height of the inlet conduit.

Since the space for filtering and recovering debris is convergent between a front opening and an outlet, the height of this space, in the region of the front opening, is at a maximum, whilst the height of this space in the region of the rear extreme portion is minimal. Such a space for filtering and recovering debris is, for example, generally conical or semi-conical. In this instance, the axis along which this cone or semi-cone extends is substantially parallel with the plane of the immersed surface over which the device according to the invention is moving.

Advantageously and according to the invention, each space for filtering and recovering debris is delimited by a lower filtering wall which is inclined in a direction which is non-perpendicular relative to the direction which connects the front opening of the filtering device and the liquid outlet out of the hollow body with which this space for filtering and recovering debris is in communication.

If this space for filtering and recovering debris is delimited by a filtering pocket, this pocket has a lower wall which is inclined backwards and upwards from a base portion of the pocket for recovering debris in a direction which is non-perpendicular relative to the direction which connects the front opening of the filtering device and the liquid outlet out of the hollow body with which this space for filtering and recovering debris is in communication.

Such a wall which has an orientation which is non-perpendicular relative to the direction which connects the front opening of the filtering device and the liquid outlet allows it to be ensured that the general orientation of the liquid which flows between this front opening and this liquid outlet does not pass this wall in a frontal manner in a normal direction but instead with an incident direction in accordance, for example, with an angle of between 20° and 70° relative to the wall which allows the phenomena of clogging with debris to be limited on this inclined lower wall.

Furthermore, such a lower inclined wall provides a space between the base of the hollow body and this wall such that it is possible to provide at this location members of the device such as one or more motors for driving the device over the immersed surface.

This inclined lower wall may have any type of inclination which is non-perpendicular relative to at least one direction—in particular each direction—which connects a front opening of the filtering device and a liquid outlet—in particular each liquid outlet—out of the hollow body.

Advantageously and according to the invention, this lower filtering wall has an inclination, relative to the longitudinal direction, of between 15° and 60°.

Advantageously and according to the invention, each space for filtering and recovering debris is further delimited by an upper wall which is generally horizontal and which extends from a front opening towards the rear and which is connected to the lower filtering wall by an upper rear extreme curved portion.

Advantageously and according to the invention, each space for filtering and recovering debris is delimited by a rigid frame and a filtering sheet which extends into openings provided by the rigid frame.

Such a structure forms a rigid pocket for filtering and recovering debris.

Advantageously and according to the invention, the hydraulic circuit comprises at least one axial pumping propeller which is arranged downstream of the filtering device in order to generate a flow of liquid in a liquid outlet, the axial pumping propeller being coupled to a drive motor which is arranged below a rear portion of the filtering device.

The pumping motor is preferably arranged below the lower inclined wall of the pocket for filtering and recovering debris.

Such an arrangement results in a more compact device according to the invention and allows the vertical and horizontal spatial requirement of the device to be significantly reduced which contributes to reducing the hydraulic drag of the device.

Advantageously and according to the invention, the axial pumping propeller is arranged in a cylindrical fairing which forms the liquid outlet.

Advantageously and according to the invention, the axial pumping propeller and the cylindrical fairing are orientated so as to generate a liquid flow in a direction which forms with the longitudinal direction an angle which is not zero and which is different from 90°.

A device according to the invention comprises, for access to the filtering device, a flap which is provided on an upper wall of the hollow body and which is capable of allowing the filtering device to be disassembled and removed from the hollow body in order to clean it.

This allows the filtering device to be readily and rapidly disassembled from the upper wall of the hollow body whilst the device rests on a horizontal surface in a normal position which corresponds to the cleaning position thereof. It is therefore simple with a device according to the invention to remove the filtering device in order, for example, to clean it. This disassembly does not involve inverting the device.

Advantageously and according to the invention, the filtering device comprises ribs which extend laterally at each side of the filtering device and which have a shape and dimensions which correspond to and which complement the shape and dimensions of grooves which are fixedly joined to the hollow body in order to allow the filtering device to slide along the grooves in order to remove the filtering device from the hollow body via the access flap.

In this manner, removing the filtering device from the hollow body via the upper flap results in a translation movement of the filtering device along the grooves of the hollow body. A user can therefore readily remove the filtering device from the hollow body in order, for example, to clean it. After the filtering device has been cleaned, a user can readily reintroduce the filtering device into the hollow body by orientating the filtering device so that the ribs of the filtering device are opposite the grooves of the hollow body, then sliding the filtering device into the hollow body.

The invention further relates to a device for cleaning an immersed surface characterized in combination by all or some of the features mentioned above or below.

Figure 2:
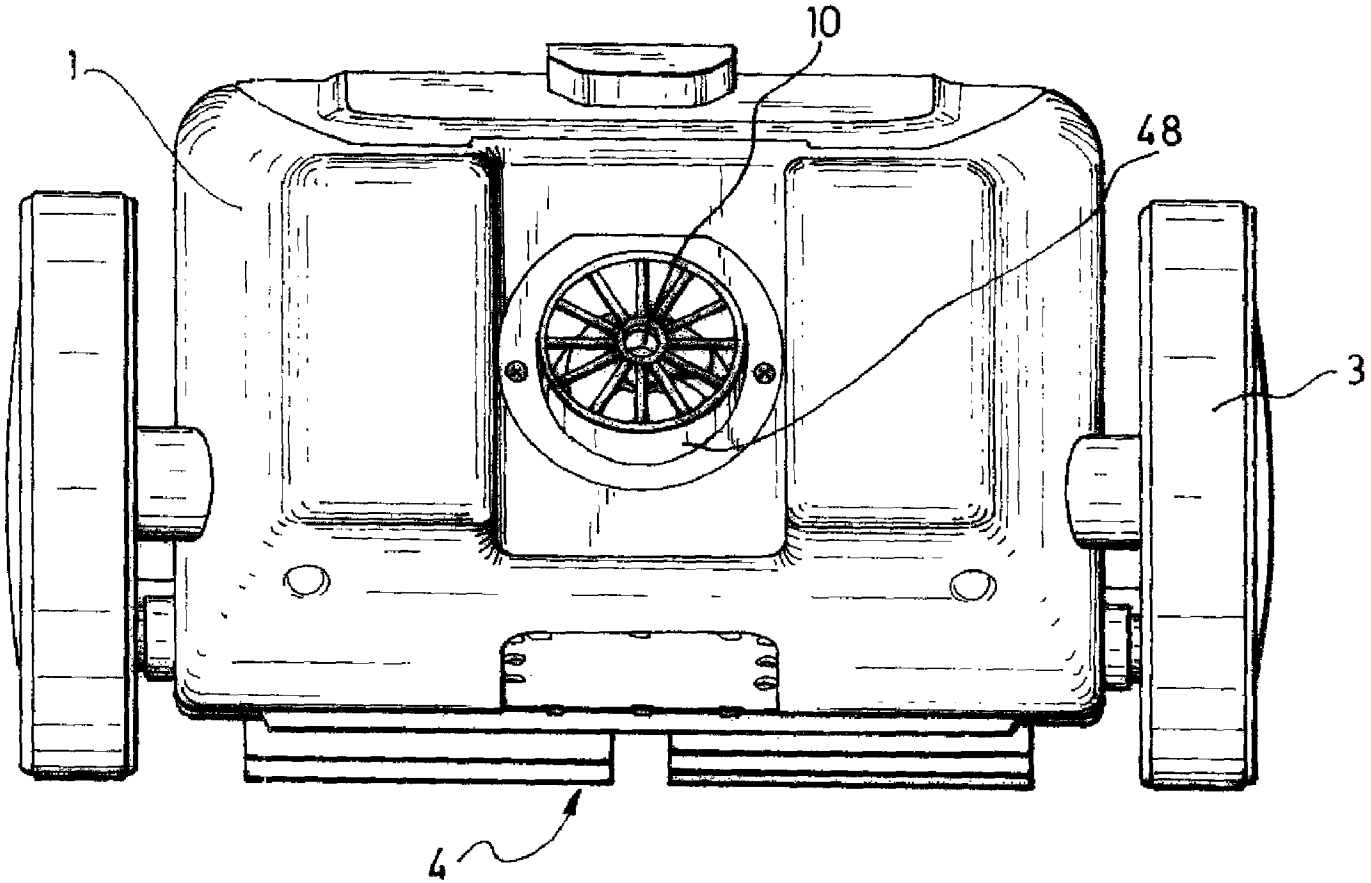
Figure 3:
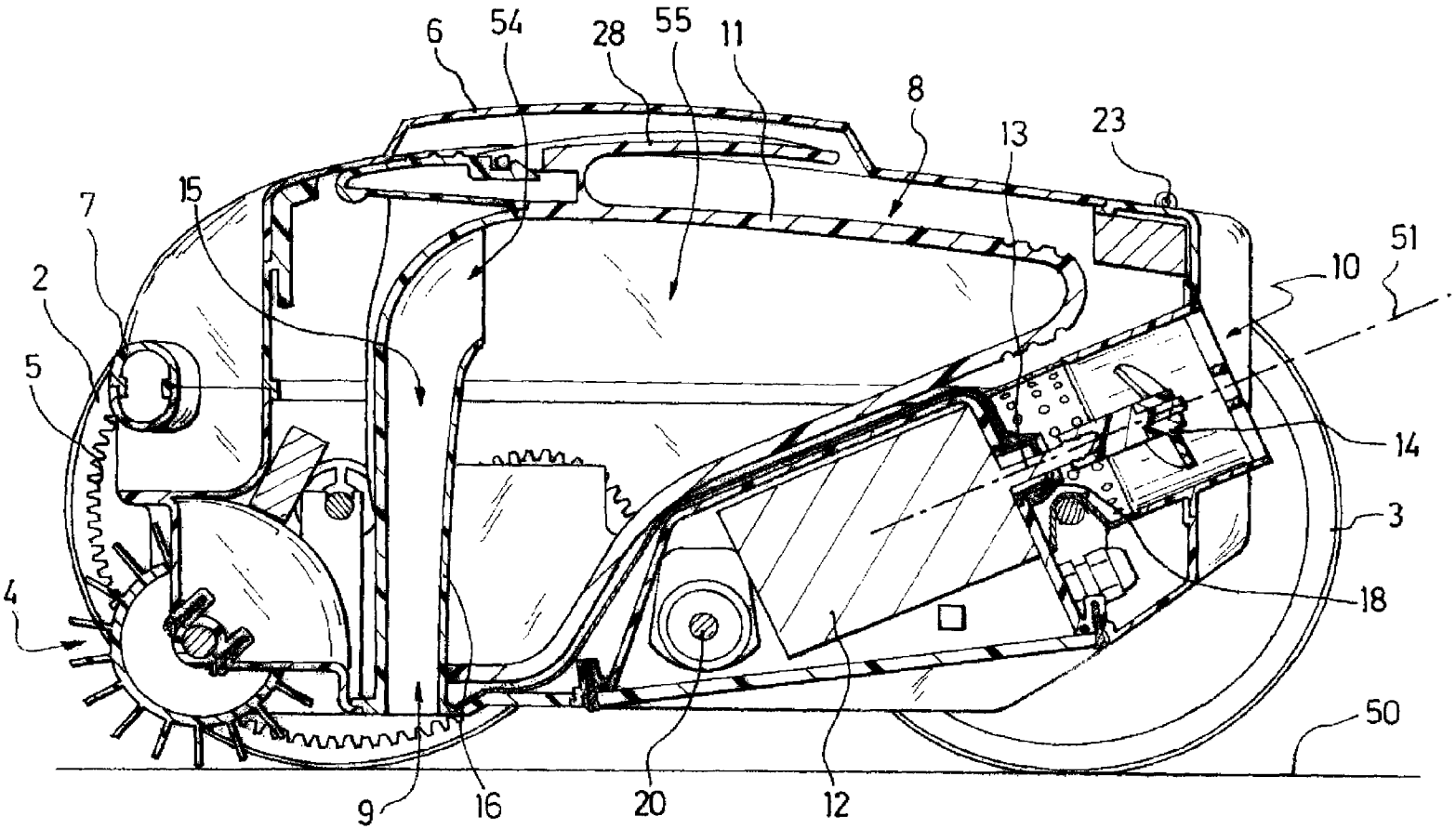
Figure 4:
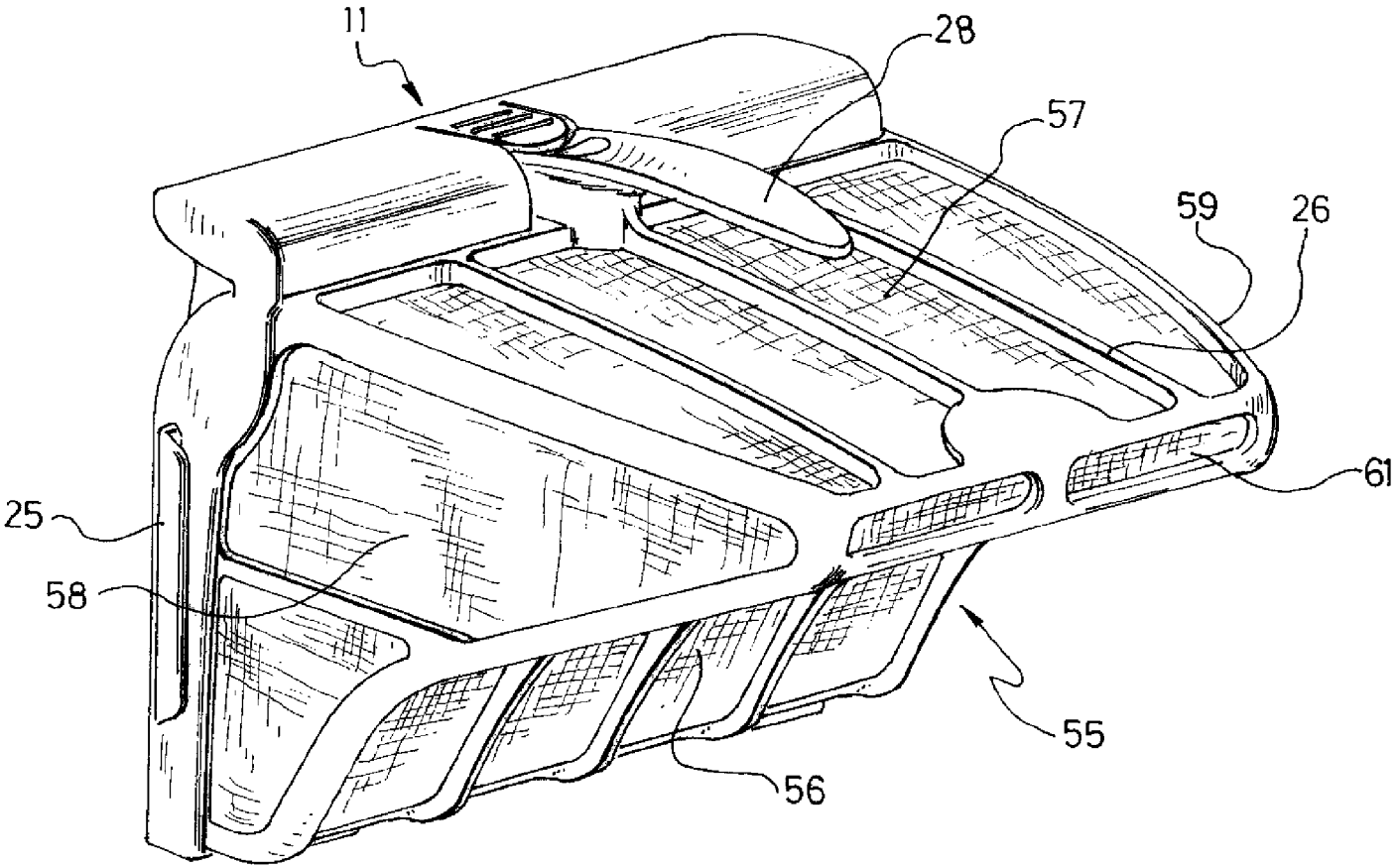
Figure 5:
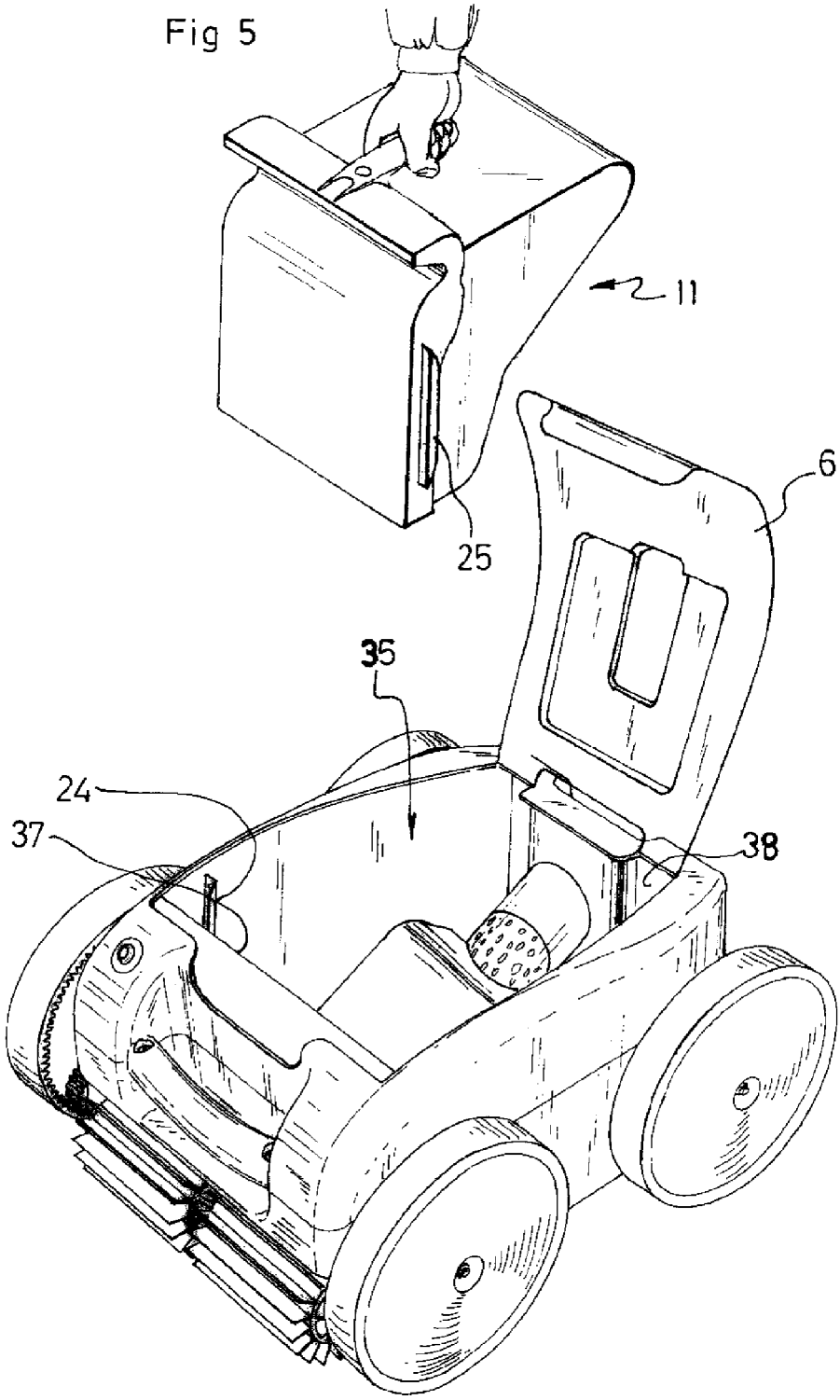
Figure 6:
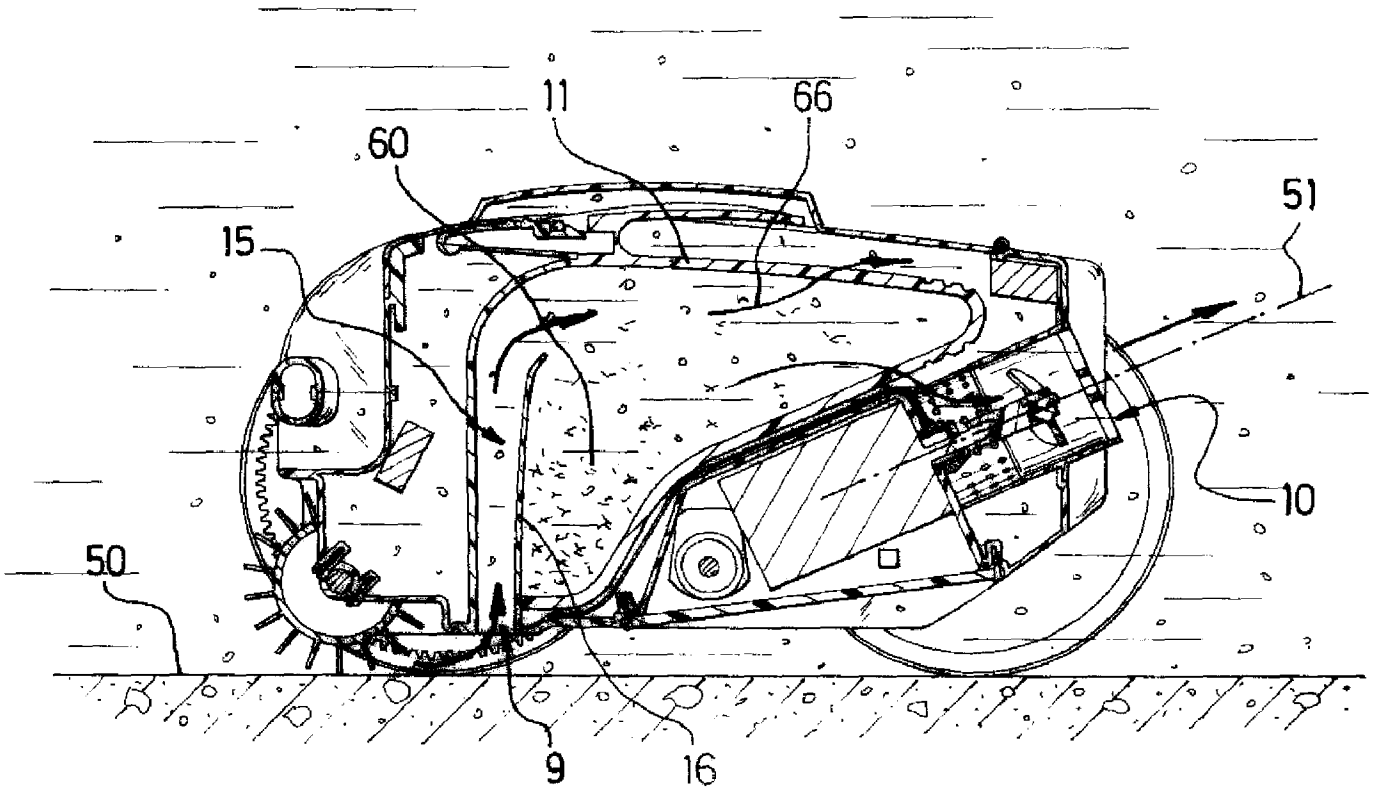

Other features, objectives and advantages of the invention will be appreciated from a reading of the following description which sets out, by way of non-limiting example, an embodiment of the invention with reference to the appended drawings, in which:

FIG. 1 is a schematic perspective view of a cleaning device according to an embodiment of the invention, FIG. 2 is a schematic rear view of a cleaning device according to an embodiment of the invention, FIG. 3 is a schematic section of a cleaning device according to an embodiment of the invention, FIG. 4 is a schematic perspective view of a filtering device according to an embodiment of the invention, FIG. 5 is a schematic perspective view of a device according to an embodiment of the invention with the flap open and the filtering device being removed from the device from this open flap, FIG. 6 is a simplified schematic section of FIG. 3 illustrating the device during operation over an immersed surface.

In the Figures, the scales and proportions are not strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear are defined.

A device according to the invention comprises a hollow body 1 and rolling members 2, 3, 4 for guiding and driving the hollow body 1 over an immersed surface in at least one preferred direction of advance and in a main direction of advance called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber which is capable of receiving a filtration chamber. This central chamber 35 is delimited by means of a lower wall which extends in a substantially horizontal plane; by lateral walls which generally extend in vertical planes; by a front wall 37 which generally extends in a vertical plane, orthogonal relative to the planes of the vertical lateral walls; and by a rear wall 38 which generally extends in a vertical plane orthogonal relative to the planes of the vertical lateral walls.

The lower wall has an opening which extends transversely in the region of the front wall 37 so that liquid is able to be introduced into the central chamber 35 via this lower transverse opening. This opening forms a liquid inlet 9 in the hollow body 1.

The rear wall 38 comprises a cylindrical opening which forms a liquid outlet 10 out of the hollow body 1. This liquid outlet 10 which is provided in the rear wall 38 of the housing is longitudinally offset from the liquid inlet 9 which is provided in the lower wall. Furthermore, this liquid outlet 10 is provided in the upper portion of the housing in such a manner that it is also vertically offset from the liquid inlet 9.

This central chamber 35, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

The transverse opening which is provided in the lower wall of the housing forms the liquid inlet 9 of the device and the cylindrical opening which is provided in the rear wall of the device forms the liquid outlet 10 of the device.

Preferably, the liquid inlet 9 and liquid outlet 10 are centered in the same vertical longitudinal center plane of the device.

The central chamber of the hollow body 1 is capable of receiving a filtering device 11. The filtering device 11 is provided between the liquid inlet 9 and the liquid outlet 10.

According to the invention, this filtering device 11 comprises a front opening 54 which is in communication with the liquid inlet 9 and a space 55 for filtering and recovering debris. This space 55 for filtering and recovering debris is delimited by a rigid pocket 55.

According to other embodiments, this space may be delimited by a flexible pocket, a casing, a cartridge and any other equivalent device.

This pocket 55 extends between the front opening 54 and the liquid outlet 10.

A filtering device 11 further comprises a liquid inlet conduit 15 which extends from the liquid inlet 9 as far as the front opening 54 which is connected to the pocket 55 for filtering and recovering debris. In this manner, the front opening 54 is provided opposite the upper end of this liquid inlet conduit 15 which extends from the liquid inlet 9. This liquid inlet conduit 15 has a rear wall which is called a non-return wall 16 and which is arranged between the liquid inlet and the pocket 55 for filtering and recovering debris.

This pocket 55 for filtering and recovering debris is formed by a rigid frame 26 and a filtering sheet—in particular a filtering material—which extends into openings which are provided by this frame. It thus comprises, as illustrated in FIG. 4, rigid filtering walls 56, 57, 58, 59. The filtering device 11 is therefore self-supporting and can be readily handled by a user.

The pocket 55 for filtering and recovering debris has a regular cross-section which decreases from the front opening 54 towards the liquid outlet 10 in order to form a convergent chamber for tangential filtering of the liquid flowing between the front opening 54 and the liquid outlet 10.

According to the embodiment of the Figures, the pocket 55 for filtering and recovering debris has a lower filtering wall 56 which is inclined backwards and upwards from a base portion of the pocket 55.

This inclined lower wall 56 forms with the longitudinal direction an angle which, in the example illustrated, is in the order of 45°.

This filtration pocket 55 further comprises a generally horizontal upper wall 57 which extends towards the rear from the front opening 54. This upper filtering wall 57 is connected to the lower filtering wall 56 via an upper rear extreme curved portion 61.

The rear extreme curved portion 61 has a minimal regular cross-section whilst the portion of the pocket 55 opposite this curved portion 61, that is to say, in the region of the front opening 54, has a maximum regular cross-section. In this manner, the filtration pocket 55 has a regular cross-section which decreases from the front opening 54 towards the rear extreme curved portion 61, that is to say, towards the rear outlet 10. That is to say, the filtration pocket 55 has a regular cross-section which is in the form of a rectangular triangle, the inclined lower wall 56 forming the hypotenuse.

The device also comprises a flap 6 for access to this filtering device. This access flap 6 forms an upper wall of the hollow body 1 and covers it. In the embodiment illustrated, this flap 6 is arranged on the upper portion of the device so that a person using the device can readily open the flap 6 and remove the filtering device 11. Preferably, the access flap 6 is articulated to the body 1 of the device by means of hinges 23 which are provided at the rear of the device.

Preferably, the filtering device 11 is a device which is mounted in the central chamber 35 of the hollow body 1 in the manner of a drawer. To this end, the rigid frame 26 of the filtering device 11 further has two ribs 25 which extend laterally from each side of the filtering device 11. These ribs 25 have shapes and dimensions which correspond to and complement the shapes and dimensions of grooves 24 which are fixedly joined to the hollow body 1. These grooves 24 which are fixedly joined to the hollow body 1 extend vertically along the inner faces of the vertical lateral walls of the hollow body 1. The ribs 25 of the filtering device 11 are therefore capable of co-operating with the grooves 24 of the hollow body 1 of the device.

In this manner, the removal of the filtering device 11, as illustrated in FIG. 5, is the result of a translation movement of the filtering device 11 along the grooves 24 of the hollow body 1. A user can therefore readily remove the filtering device 11 from the hollow body 1, for example, in order to clean it. After the filtering device 11 has been cleaned, a user can readily reintroduce the filtering device 11 into the hollow body 1 by orientating the filtering device 11 so that the ribs 25 of the filtering device 11 are opposite the grooves 24 of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is out of the liquid and rests on a horizontal surface.

According to the invention, a device comprises a motorized liquid pumping device which comprises an electric pumping motor 12 which has a rotating drive shaft 13 which is coupled to a pumping propeller 14 which is interposed in the hydraulic circuit in order to generate therein a liquid flow between the liquid inlet 9 and the liquid outlet 10. The liquid outlet 10 is directly opposite the pumping propeller so that the liquid flows out of the liquid outlet 10 in a direction which corresponds to the liquid flow generated by the pumping propeller, this flow having a speed which is orientated along the rotation axis 51 of the propeller 14.

The pumping propeller 14 has an orientation which allows a flow of liquid to be generated with a horizontal component towards the rear.

Preferably, the pumping propeller 14 which is interposed in the hydraulic circuit between the liquid inlet 9 and the liquid outlet 10 has an inclined rotation axis which forms, with the longitudinal direction and with the theoretical rolling plane 50, an angle $\alpha$ which is not 90°. This propeller 14 is rotated by means of the electric pumping motor 12 which preferably has a rotating drive shaft 13 which is parallel with the rotation axis of the propeller 14.

According to the invention, the electric pumping motor 12 is arranged below the hydraulic circuit entirely at the outer side of this hydraulic circuit which completely bypasses the pumping motor 12 at the top. The rotary shaft 13 of the pumping motor 12 extends through a lower inclined wall 30 which delimits the hydraulic circuit. The sealing is provided by an O-ring 18.

FIG. 6 is an illustration of the flow of liquid in the hollow body 1 of the device. This flow is illustrated schematically in FIG. 6 by means of the arrows 66. Liquid enters the hollow body 1 via the liquid inlet 9 which is arranged below the device. This liquid passes into the liquid inlet conduit 15 in order to reach the filtering device 11. This filtering device 11 allows the liquid to pass through the filtering material and retains the solid debris 60. The filtered liquid reaches the liquid outlet 10 and is discharged at the rear of the device into the pool from which it originates.

Since the liquid outlet 10 is opposite the pumping propeller 14, the liquid flows out of the device via this outlet with a speed V which is orientated along the axis 51 of the pumping propeller 14 and which has towards the rear a longitudinal component which brings about, by means of reaction, forces whose resultant has a longitudinal drive component which is orientated towards the front and which is involved in driving the device over the immersed surface.

The orientation of the hydraulic reaction force created by the outlet flow and therefore the size of the longitudinal component thereof are dependent on the inclination $\alpha$ relative to the theoretical rolling plane 50, the rotation axis 51 of the propeller and the liquid outlet 10. Preferably, this inclination a is between 15° and 45°.

According to the invention, the electric pumping motor is arranged below the hydraulic circuit entirely at the outer side of this hydraulic circuit so that the filtering device 11 of the hydraulic circuit can be removed from the device via the top of the device as mentioned above, without being impeded by the pumping motor. Only the pumping propeller 14 is arranged in the hydraulic circuit so as to be able to provide the liquid flow. This pumping propeller 14 is arranged at the rear of the device, close to the liquid outlet 10. That is to say, the pumping propeller 14 and the liquid outlet 10 form the end portion of the hydraulic circuit.

In the preferred embodiment of the invention illustrated in the Figures, the rolling members for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed towards the rear of the device in the direction of the liquid inlet 9 which is arranged below the device.

The device further comprises at least one electric motor 20 for driving the front drive wheels 2. Preferably, the device comprises two drive motors, one at each side, for independently driving each of the front wheels 2, respectively. To this end, each front wheel 2 has an inner toothed arrangement 5 which co-operates with a pinion which is driven by the corresponding drive motor 20.

The electric drive motor 20 and the electric pumping motor 12 may be of any known type. According to a preferred embodiment, these electric motors are low-voltage motors. They can be supplied with electrical power via an electrical power supply external to the device via an electrical cable which is not illustrated in the Figures and which is connected to the device in the region of a zone 19 for introducing the electrical cable into the device, as illustrated in FIG. 1.

These brushes 4 may be of any type. According to an embodiment of the invention, the device comprises two front coaxial brushes 4. Each brush 4 is capable of being rotated about an axis which extends in a direction perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by at least one electric motor 20 for driving the front wheels 2 by means of a gear system.

In this manner, in the embodiment illustrated, the rolling members are constituted by the front drive wheels 2, rear non-drive wheels 3 and brushes 4 which are involved in driving and guiding the device over the immersed surface. In any case, the rolling members 2, 3, 4 have zones which are intended to come into contact with the immersed surface which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, the front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

Furthermore, according to a preferred embodiment of the invention, the device also comprises an operating handle 7 which allows a user to carry the device in order to immerse it in a liquid and remove it therefrom. This handle 7 is preferably arranged opposite the liquid outlet 10 so that when the hollow body 1 is suspended via this handle, the device tilts spontaneously under the effect of gravity into a position in which the liquid outlet 10 is located below the liquid inlet 9 which allows the device to be emptied. When the device moves from the cleaning position to the emptying position, the debris drawn in by the device are retained in the filtering device and cannot be discharged from the device.

Of course, the invention may involve numerous construction variants and applications.

For example, according to an embodiment which is not illustrated in the Figures, the filtering device 11 may have an upper wall which forms the upper wall of the housing of the device so that a user can directly grip the filtering device 11 and remove it from the device.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner comprising:

a. a body comprising an inlet and an outlet;

b. a pumping device configured to cause water to flow from the inlet to the outlet; and c. a filtering device (i) positioned between the inlet and the outlet so as to filter water flowing therethrough, (ii) comprising a front opening communicating with the inlet, and (iii) defining a space delimited by filtering walls, the space having a cross-section which decreases from the front opening toward the outlet to form a convergent filter chamber.

2. A swimming pool cleaner according to claim 1 in which the filtering device has a base portion and in which at least one of the filtering walls is a lower filtering wall that is inclined backward and upward from the base portion.

3. A swimming pool cleaner according to claim 2 in which at least one of the filtering walls is an upper filtering wall oriented generally horizontally when the body is upright.

4. A swimming pool cleaner according to claim 3 in which at least one of the filtering walls is an upper extreme curved portion connecting the lower and upper filtering walls.

5. A swimming pool cleaner according to claim 2 in which the space has cross-section in the form of a rectangular triangle in which the lower filtering wall forms the hypotenuse thereof.

6. A swimming pool cleaner according to claim 1 in which the body further comprises an upper wall, further comprising a flap provided in the upper wall for accessing the filtering device.

7. A swimming pool cleaner according to claim 6 in which the filtering device has a base portion and in which at least one of the filtering walls is a lower filtering wall that is inclined backward and upward from the base portion.

8. A swimming pool cleaner according to claim 7 in which at least one of the filtering walls is an upper filtering wall oriented generally horizontally when the body is upright.

9. A swimming pool cleaner according to claim 8 in which at least one of the filtering walls is an upper extreme curved portion connecting the lower and upper filtering walls.

10. A swimming pool cleaner according to claim 7 in which the space has cross-section in the form of a rectangular triangle in which the lower filtering wall forms the hypotenuse thereof.

11. A swimming pool cleaner according to claim 1 in which the filtering device is positioned wholly within the body.

* * * * *